US009407984B2

(12) United States Patent
Tong et al.

(10) Patent No.: US 9,407,984 B2
(45) Date of Patent: Aug. 2, 2016

(54) METHOD AND APPARATUS FOR ADJUSTING SOUND QUALITY

(75) Inventors: Hann-Shi Tong, Taoyuan County (TW); Lei Chen, Taoyuan County (TW); Wei-Syuan Lin, Taoyuan County (TW); Yu-Sheng Lee, Taoyuan County (TW); Yu-Chieh Lai, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 584 days.

(21) Appl. No.: 13/401,809

(22) Filed: Feb. 21, 2012

(65) Prior Publication Data

US 2012/0219169 A1 Aug. 30, 2012

Related U.S. Application Data

(60) Provisional application No. 61/446,055, filed on Feb. 24, 2011.

(51) Int. Cl.
*H04R 1/28* (2006.01)
*H04R 1/02* (2006.01)

(52) U.S. Cl.
CPC ..... *H04R 1/2811* (2013.01); *H04R 1/026* (2013.01); *H04R 2499/11* (2013.01); *Y10T 29/49826* (2015.01)

(58) Field of Classification Search
None
See application file for complete search history.

(56) References Cited

U.S. PATENT DOCUMENTS 5,384,844 A * 1/1995 Rydbeck ..... 379/433.13
5,832,079 A * 11/1998 Rabe ..... 379/433.13
5,883,966 A * 3/1999 Kubo ..... 381/386
5,896,461 A * 4/1999 Faraci et al. ..... 381/386
6,091,964 A * 7/2000 Frohlund ..... 455/575.3
6,321,070 B1 * 11/2001 Clark et al. ..... 455/575.1
6,484,020 B1 * 11/2002 Dunleavy et al. ..... 455/350
6,785,395 B1 * 8/2004 Arneson et al. ..... 381/334
6,819,939 B2 * 11/2004 Masamura ..... 455/550.1
7,187,956 B2 * 3/2007 Sugino et al. ..... 455/575.3
7,228,158 B2 * 6/2007 Lee et al. ..... 455/575.3
7,242,785 B2 * 7/2007 McNary ..... 381/182

(Continued)

FOREIGN PATENT DOCUMENTS

CN 200994185 Y 12/2007
CN 101150882 A 3/2008

(Continued)

OTHER PUBLICATIONS

Kurtus, Ron "How obstacles affect sound." pp. 1-4. Dec. 20, 2004. http://www.school-for-champions.com/science/sound_obstacles.htm#.VeYj-vIdXux.*

(Continued)

*Primary Examiner* — Curtis Kuntz
*Assistant Examiner* — Qin Zhu
(74) *Attorney, Agent, or Firm* — Jianq Chyun IP Office

(57) ABSTRACT

An electronic apparatus and a method for providing a sound system of the electronic apparatus are provided herein. The electronic apparatus has a housing, a speaker and a bracket. The housing has a space and a channel, which is coupled to the space. The speaker is placed in the space. The bracket has a first end coupled to the channel and is movable relative to the housing. A sound mode of the electronic apparatus may be switched from a first mode to a second mode by positioning a second end of the bracket from a first position in the channel to a second position away from the channel.

18 Claims, 9 Drawing Sheets

(56) References Cited

U.S. PATENT DOCUMENTS

| | | | | |
|---|---|---|---|---|
| 7,266,204 | B2 * | 9/2007 | Watson et al. | 381/86 |
| 7,266,399 | B2 * | 9/2007 | Sawamura | 455/575.3 |
| 7,324,834 | B2 * | 1/2008 | Yamaguchi et al. | 455/556.1 |
| 7,680,293 | B2 * | 3/2010 | Lin et al. | 381/349 |
| 7,778,431 | B2 * | 8/2010 | Feng et al. | 381/160 |
| 7,869,617 | B2 * | 1/2011 | Jang et al. | 381/396 |
| 7,933,123 | B2 * | 4/2011 | Wang et al. | 361/679.56 |
| 7,953,460 | B2 * | 5/2011 | You | 455/575.1 |
| 7,953,461 | B2 * | 5/2011 | Fukazawa | 455/575.1 |
| 7,979,099 | B2 * | 7/2011 | Park | 455/575.4 |
| 7,990,457 | B2 * | 8/2011 | Lee et al. | 348/333.06 |
| 8,005,516 | B2 * | 8/2011 | Ohki et al. | 455/575.1 |
| 8,005,521 | B2 * | 8/2011 | Cho et al. | 455/575.3 |
| 8,014,838 | B2 * | 9/2011 | Takasaki et al. | 455/575.3 |
| 8,014,843 | B2 * | 9/2011 | Birch et al. | 455/575.4 |
| 8,032,192 | B2 * | 10/2011 | Park | 455/575.4 |
| 8,041,072 | B2 * | 10/2011 | Kondo et al. | 381/431 |
| 8,068,806 | B2 * | 11/2011 | Taniguchi et al. | 455/350 |
| 8,086,285 | B2 * | 12/2011 | McNamara et al. | 455/575.1 |
| 8,090,136 | B2 * | 1/2012 | Rashish et al. | 381/388 |
| 8,098,868 | B2 * | 1/2012 | Kim et al. | 381/351 |
| 8,112,130 | B2 * | 2/2012 | Mittleman et al. | 455/575.1 |
| 8,121,329 | B2 * | 2/2012 | Groset et al. | 381/333 |
| 8,145,144 | B2 * | 3/2012 | Krenz et al. | 455/90.3 |
| 8,177,111 | B2 * | 5/2012 | Yeh | 224/571 |
| 8,189,848 | B2 * | 5/2012 | Lim | 381/386 |
| 8,228,678 | B2 * | 7/2012 | Hasegawa et al. | 361/755 |
| 8,229,521 | B2 * | 7/2012 | Kang et al. | 455/575.2 |
| 8,238,595 | B2 * | 8/2012 | Horowitz et al. | 381/345 |
| 8,248,765 | B2 * | 8/2012 | Zhou | 361/679.01 |
| 8,265,308 | B2 * | 9/2012 | Gitzinger et al. | 381/152 |
| 8,265,319 | B2 * | 9/2012 | Groset et al. | 381/334 |
| 8,275,121 | B2 * | 9/2012 | Demuynck et al. | 379/433.12 |
| 8,275,425 | B2 * | 9/2012 | Han et al. | 455/575.1 |
| 8,289,688 | B2 * | 10/2012 | Behar et al. | 361/679.3 |
| 8,295,959 | B2 * | 10/2012 | Wakabayashi | 700/94 |
| 8,359,072 | B2 * | 1/2013 | Kaneda et al. | 455/566 |
| 8,374,656 | B2 * | 2/2013 | Joung et al. | 455/575.3 |
| 8,437,493 | B2 * | 5/2013 | Nho et al. | 381/386 |
| 8,447,052 | B2 * | 5/2013 | Lee et al. | 381/152 |
| 8,494,602 | B2 * | 7/2013 | Wang et al. | 455/575.4 |
| 8,503,970 | B1 * | 8/2013 | Uyehara | 455/350 |
| 8,520,886 | B2 * | 8/2013 | Wilk | 381/407 |
| 8,531,393 | B2 * | 9/2013 | Ranta et al. | 345/156 |
| 8,570,737 | B2 * | 10/2013 | Rayner | 361/679.56 |
| 8,587,933 | B2 * | 11/2013 | Ho et al. | 361/679.01 |
| 8,588,858 | B2 * | 11/2013 | Shim et al. | 455/566 |
| 8,593,350 | B2 * | 11/2013 | Abe | 343/702 |
| 8,593,397 | B2 * | 11/2013 | Ranta et al. | 345/156 |
| 8,616,422 | B2 * | 12/2013 | Adelman et al. | 224/191 |
| 8,750,553 | B2 * | 6/2014 | Park et al. | 381/387 |
| 2004/0202338 | A1 * | 10/2004 | Longbotttom et al. | 381/190 |
| 2005/0031148 | A1 | 2/2005 | McNary | |
| 2005/0049018 | A1 * | 3/2005 | Chiang et al. | 455/575.1 |
| 2005/0130716 | A1 * | 6/2005 | Shin et al. | 455/575.1 |
| 2006/0022950 | A1 * | 2/2006 | Friedrichs | 345/169 |
| 2006/0063570 | A1 * | 3/2006 | Nishimura | 455/575.3 |
| 2007/0032273 | A1 * | 2/2007 | Hsiao et al. | 455/575.1 |
| 2007/0099681 | A1 * | 5/2007 | Kielland | 455/575.1 |
| 2007/0184786 | A1 * | 8/2007 | Kim | 455/90.3 |
| 2007/0184882 | A1 * | 8/2007 | Kim | 455/575.4 |
| 2007/0258614 | A1 * | 11/2007 | Langberg | 381/379 |
| 2007/0287512 | A1 * | 12/2007 | Kilpi et al. | 455/575.1 |
| 2008/0063218 | A1 * | 3/2008 | Weber et al. | 381/87 |
| 2009/0017883 | A1 * | 1/2009 | Lin | 455/575.8 |
| 2010/0125811 | A1 * | 5/2010 | Moore et al. | 715/846 |
| 2010/0227650 | A1 * | 9/2010 | Kim et al. | 455/566 |
| 2010/0304795 | A1 * | 12/2010 | Laine et al. | 455/575.1 |
| 2011/0031287 | A1 * | 2/2011 | Le Gette et al. | 224/101 |
| 2011/0164358 | A1 * | 7/2011 | Duan | H05K 5/0234 361/679.01 |
| 2013/0058026 | A1 * | 3/2013 | Chang et al. | 361/679.2 |
| 2013/0114840 | A1 * | 5/2013 | Shin | 381/332 |
| 2013/0301863 | A1 * | 11/2013 | Weaver, III | 381/334 |
| 2014/0161293 | A1 * | 6/2014 | Wang et al. | 381/332 |

FOREIGN PATENT DOCUMENTS

| | | |
|---|---|---|
| CN | 201286168 Y | 8/2009 |
| CN | 201657284 | 11/2010 |
| CN | 201657284 U | 11/2010 |

OTHER PUBLICATIONS

"First Office Action of China Counterpart Application", issued on Dec. 25, 2013, p. 1-p. 6.

"Office Action of China Counterpart Application", issued on Jan. 23, 2015, p. 1-p. 7.

"Office Action of Taiwan Counterpart Application", issued on Jul. 31, 2014, p. 1-p. 5.

* cited by examiner

METHOD AND APPARATUS FOR ADJUSTING SOUND QUALITY

CROSS-REFERENCE TO RELATED APPLICATION

This application claims the priority benefit of U.S.A. provisional application Ser. No. 61/446,055, filed on Feb. 24, 2011. The entirety of the above-mentioned patent application is hereby incorporated by reference herein and made a part of this specification.

TECHNICAL FIELD

The present disclosure relates to an electronic apparatus with a speaker and a method for providing a sound system of the electronic apparatus, and more particularly to an electronic apparatus with a bracket and a speaker and method for providing a sound system of the electronic apparatus.

BACKGROUND

With the development of the science and technology, the use of a portable electronic apparatus (e.g. a mobile phone, a tablet computer, etc.) already becomes more and more popular. Different from a common electronic apparatus, for the sake of portability, the shape of the portable electronic apparatus is usually designed to be light, thin, and small. Accordingly, the size of the speaker embedded in the portable electronic apparatus also decreases gradually. However, due to decrease of the size of the embedded speaker, the sound quality usually becomes worse, so some users who have high requirements for the sound quality become unsatisfied.

SUMMARY

The present disclosure provides an electronic apparatus with a bracket and a speaker. A sound mode of the electronic apparatus may be switched between two modes to adjust acoustic middle range sound quality and acoustic bass sound quality of the electronic apparatus respectively.

The present disclosure provides a method for providing a sound system of an electronic apparatus. By changing the placement position of a bracket of the electronic apparatus, acoustic middle range sound quality and acoustic bass sound quality of the electronic apparatus may be respectively adjusted.

The application discloses an electronic apparatus. The electronic apparatus includes a housing, a speaker and a bracket. The housing has a space and a channel, and the space and the channel couples with each other. The speaker is disposed in the space. The bracket has a first end coupled to the channel. The bracket is movable relative to the housing.

The application discloses a method for providing a sound system of an electronic apparatus. The method includes positioning a speaker of the electronic apparatus in a space of a housing of the electronic apparatus. The method further includes coupling a bracket to a channel of the housing. The space and the channel are coupled with each other. The bracket is movable relative to the housing.

In an embodiment of the present disclosure, the bracket is placed in the channel.

In an embodiment of the present disclosure, a sound pressure level of an acoustic middle range sound from the electronic apparatus with the bracket is increased comparing with a sound pressure level of the acoustic middle range sound from an electronic apparatus without the bracket.

In an embodiment of the present disclosure, a gap is formed between the bracket and the channel when the bracket is placed in the channel.

In an embodiment of the present disclosure, a resonant frequency of a middle range boost of the electronic apparatus depends on the volume of the gap.

In an embodiment of the present disclosure, an inner chamber is formed between the bracket and the speaker when the bracket is placed in the channel.

In an embodiment of the present disclosure, the resonant frequency of the middle range boost of the electronic apparatus is represented by $f_0$.

$$f_0 = \frac{1}{2\pi}\sqrt{\frac{1}{LC}}.$$

L is an inductance value equal to $$\frac{1.21 \times L_K}{W_K \times D},$$

C is a capacitance value equal to $$\frac{V}{1.21 \times 343},$$

D is a numerical portion of the volume of the gap, $W_K$ is a numerical portion of the width of the bracket, $L_K$ is a numerical portion of the length of the bracket, V is a numerical portion of the volume of the inner chamber.

In an embodiment of the present disclosure, the electronic apparatus further comprises a hinge coupling the bracket to the channel.

In an embodiment of the present disclosure, the electronic apparatus further comprises a spring coupling the bracket to the channel.

In an embodiment of the present disclosure, the length of the channel is more than twice as much as the length of the space.

In an embodiment of the present disclosure, the channel is placed along a midline of the housing.

In an embodiment of the present disclosure, the channel is placed at one end of the housing.

In an embodiment of the present disclosure, the electronic apparatus further comprises a touch screen to be used as an interface for operating the electronic apparatus.

In an embodiment of the present disclosure, the bracket further comprises a second end which is movable between a first position in the channel to a second position away from the channel.

In an embodiment of the present disclosure, the second end which is moved away from the channel and forming an angle between the bracket and housing, the relationship between the angle and distance between a user is represented by $$s^2 = r^2 + t^2 - 2 \times r \times t \times \cos\varphi \text{ and } \varphi = \frac{\pi}{2} + \theta.$$

r is a distance from the speaker to a top of the housing, s is a distance from the top to the ear of the user, t is a distance from the speaker to the ear of the user, $\phi$ is an included angle between the bracket and a sound path from the speaker to the ear of the user, and θ is an included angle between the bracket and the housing.

In an embodiment of the present disclosure, a sound pressure level of an acoustic bass range sound from electronic apparatus with the second end of the bracket moved to the second position is increased comparing with a sound pressure level of the acoustic bass range sound from an electronic apparatus without the bracket.

In an embodiment of the present disclosure, the method further comprises positioning the second end of the bracket from the first position in the channel to the second position away from the channel.

In an embodiment of the present disclosure, the method further comprises placing the bracket in the channel. A gap is formed between the bracket and the channel, and an inner chamber is formed between the bracket and the speaker.

Based on the embodiments of the present disclosure, by changing the placement position of the bracket of the electronic apparatus, acoustic middle range sound quality and acoustic bass sound quality of the electronic apparatus are adjusted respectively.

In order to make the aforementioned and other objectives and advantages of the present disclosure comprehensible, embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
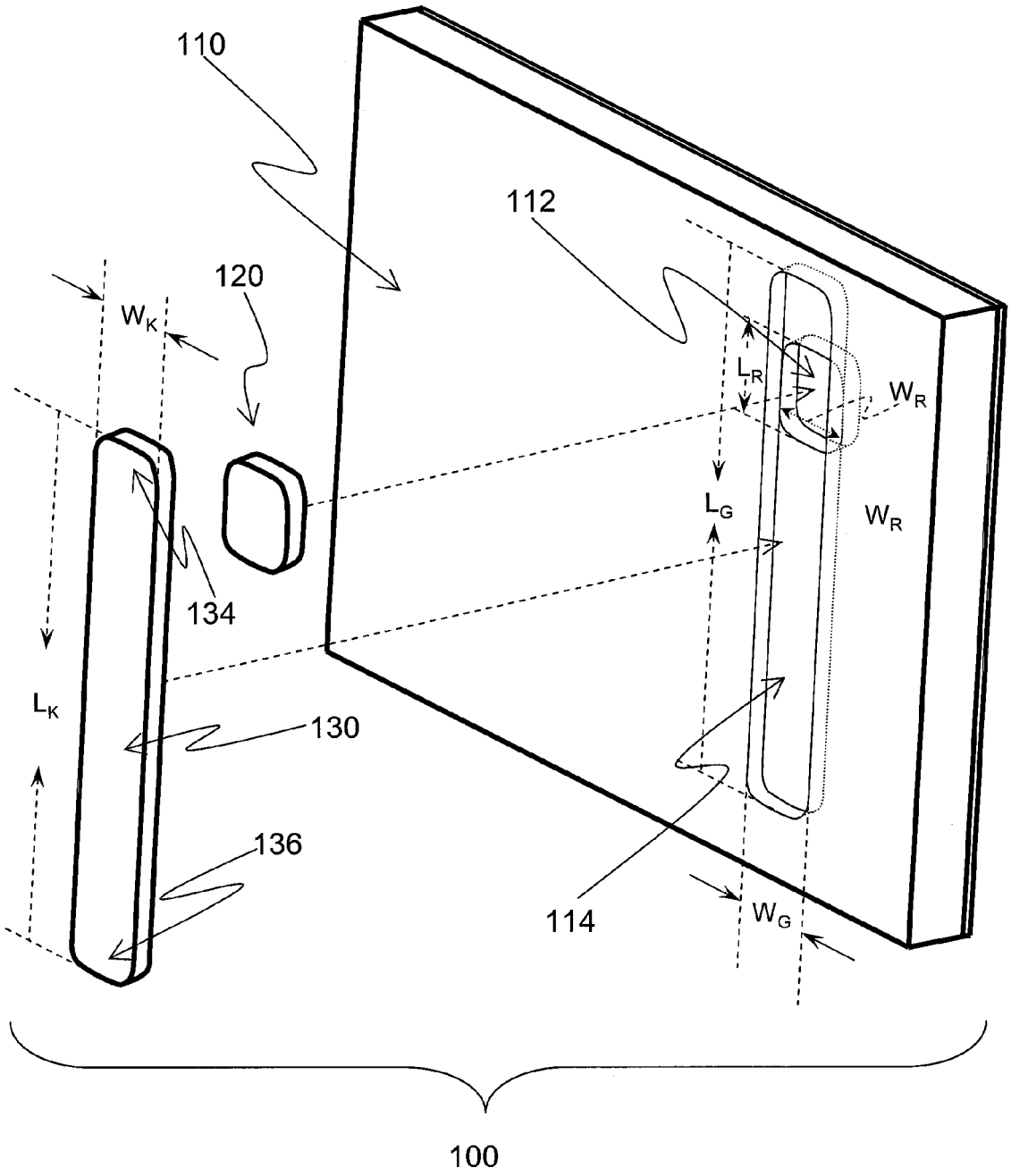
FIG. 1 is an exploded view of an electronic apparatus according to an embodiment of the present disclosure.

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may include a variety of aspects that may not be listed below.

Reference will now be made in detail to the present embodiments of the disclosure, examples of which are illustrated in the accompanying drawings. Wherever possible, the same reference numbers are used in the drawings and the description to refer to the same or like parts.

Please refer to FIG. 1 as an exploded view of an electronic apparatus 100 according to an embodiment of the present disclosure, the electronic apparatus 100 comprises a housing 110, a speaker 120 and a bracket 130. The housing 110 comprises a space 112 and a channel 114. The space 112 is coupled to the channel 114. The speaker 120 is placed in the space 112 and capable of generating sound waves. The speaker may be piezoelectric, magnetostrictive, electrostatic, ribbon magnetic, planar magnetic, bending wave, distributed mode, or flat panel speaker. The speaker 120 may comprise an array of speakers for sound producing. The bracket 130 may be a stand or bracket made out of metal, polymer, plastic or combination of such with structuring or texturing at surface of bracket. The bracket 130 may be contoured to follow the shape of housing 110. The present disclosure describes the electronic apparatus 100 as mobile, portable or handheld electronic device, such as a tablet computer, or mobile phone. Additionally, the channel 114 mentioned above may be formed at any location of the housing 110. In an embodiment of the present disclosure, the channel 114 may be placed along a midline of the housing 110. That is, the channel 114 has equal distances away from the left side and the right side of the housing 110. However, the present disclosure is not limited thereto. In other words, the distance between the channel 114 and the left side of the housing 110 may be greater or less than the distance between the channel 114 and the right side of the housing 110. In an embodiment of the present disclosure, the width $W_G$ of the channel 114 may be equal to or greater than the width $W_R$ of the space 112. In addition, the length $L_G$ of the channel 114 is greater than the length $L_R$ of the space 112. In an embodiment of the present disclosure, the length $L_G$ of the channel 114 is more than twice as much as the length $L_R$ of the space 112.

Figure 2:
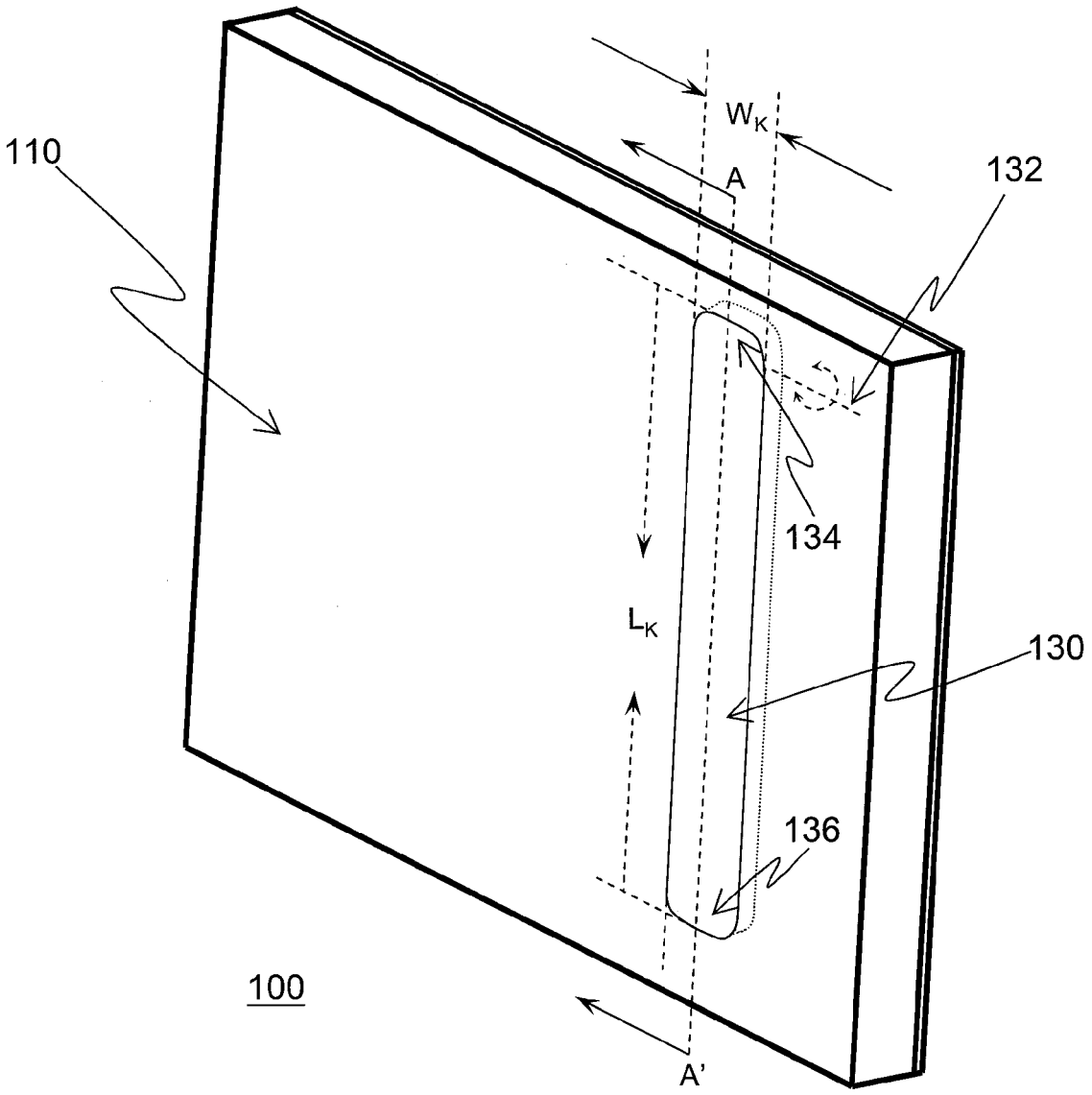
FIG. 2 is a three-dimensional schematic view of the electronic apparatus in FIG. 1 when a bracket of the electronic apparatus is closed.

Please refer the FIG. 2 as a three-dimensional schematic view when the bracket 130 of the electronic apparatus 100 is closed, the bracket 130 is placed in the channel 114 and has a first end 134 and a second end 136. The first end 134 and the second end 136 may be opposite to each other. When the bracket 130 is closed and the bracket 130 is placed in the channel 114, both the first end 134 and the second end 136 are placed in the channel 114, and the electronic apparatus 100 is adjusted to a first mode. As a user usually closes the bracket 130 during a call, the first mode may also be referred to as a voice mode.

Figure 3:
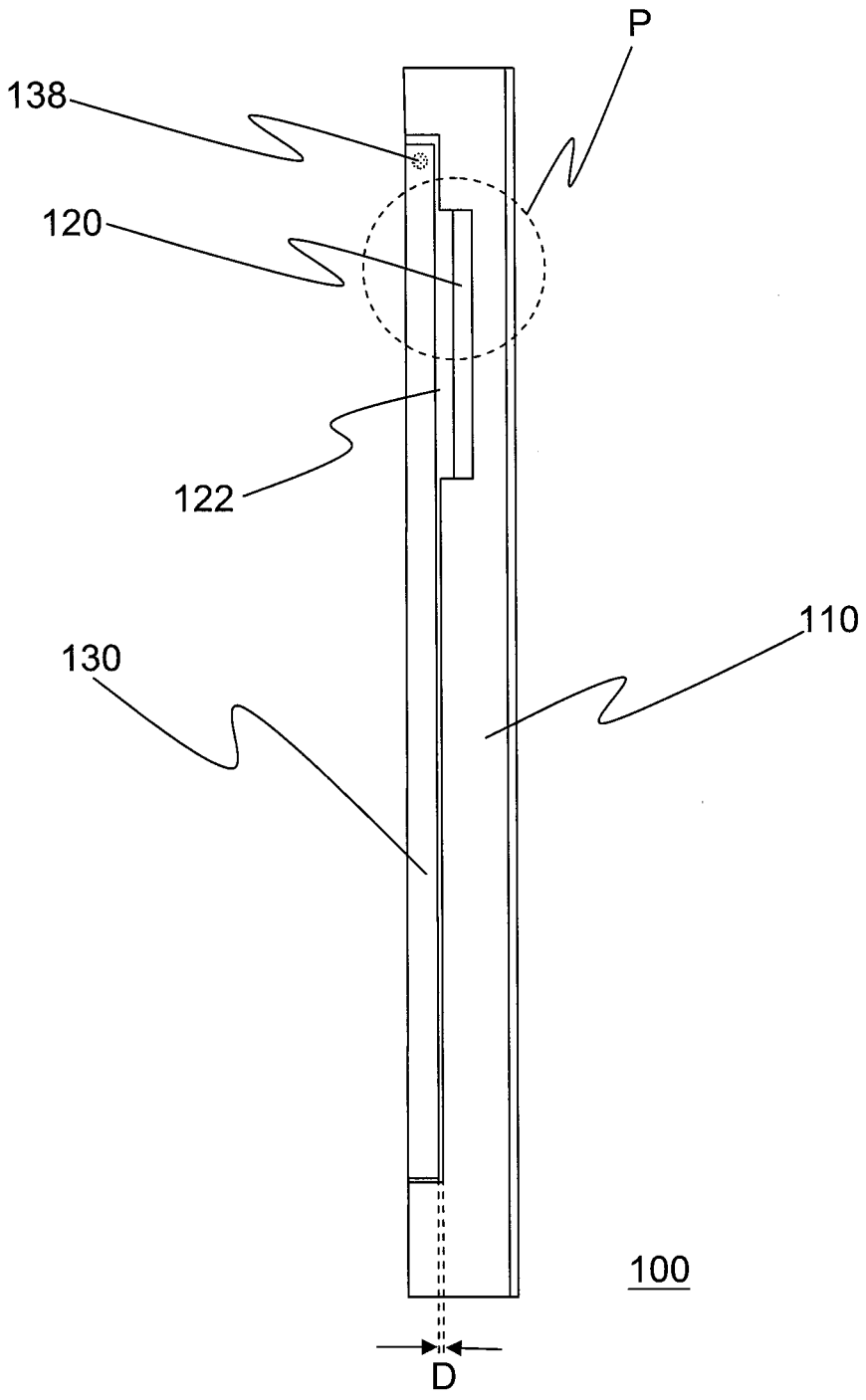
FIG. 3 is a sectional view along a dashed line A-A' of the electronic apparatus in FIG. 2.
Figure 4:
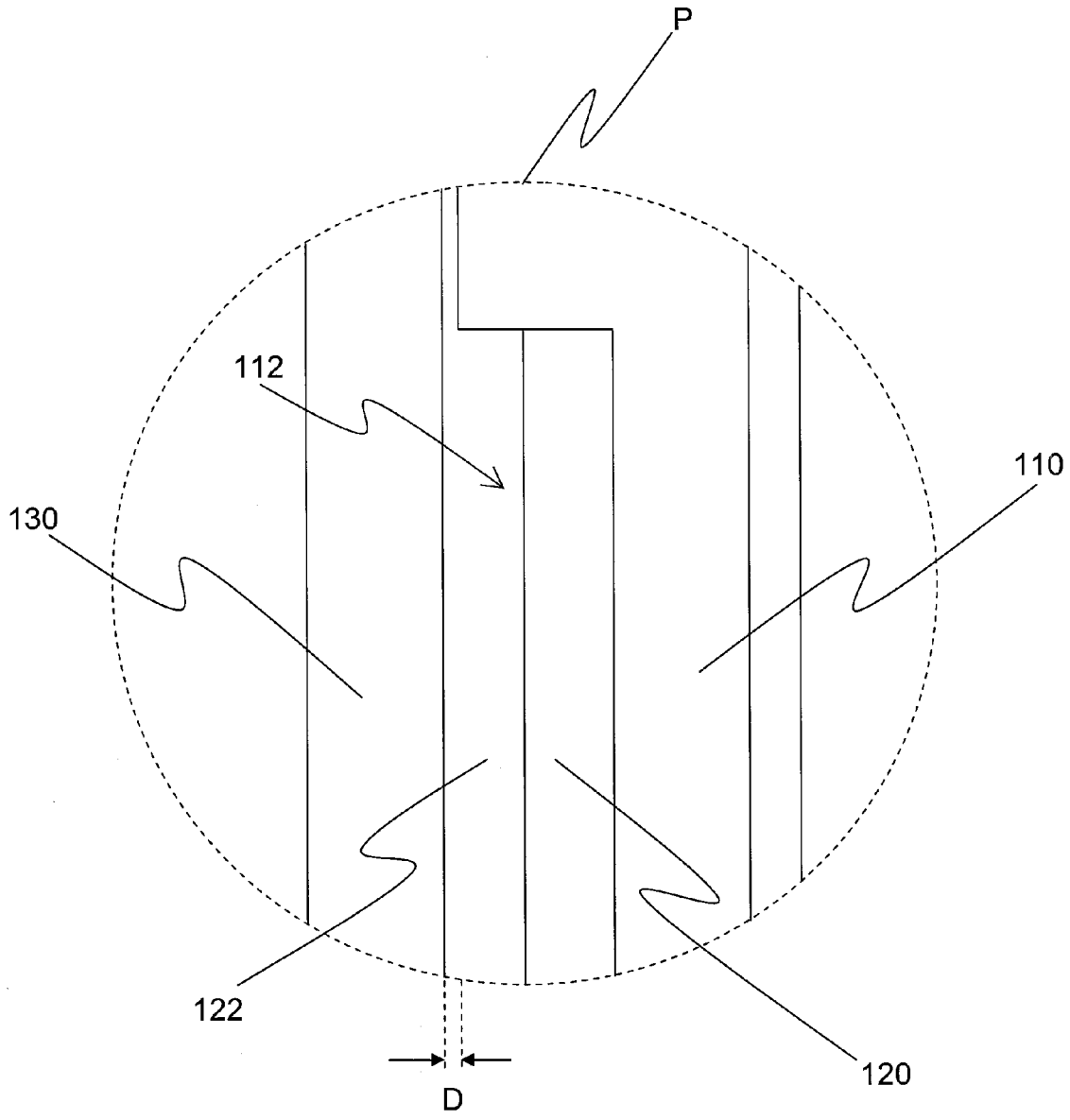
FIG. 4 is a partial enlarged view at a position P of the electronic apparatus in FIG. 3.

FIG. 3 is a sectional view along a dashed line A-A' of the electronic apparatus 100 in FIG. 2. FIG. 4 is a partial enlarged view at a position P of the electronic apparatus 100 in FIG. 3. In an embodiment of the present disclosure, when the bracket 130 of the electronic apparatus 100 is translated to close to the channel 114, a gap D is formed between the bracket 130 and the housing 110. The gap D may be greater than 0.1 millimeter. Additionally, as the volume of the space 112 is greater than the volume of the speaker 120, when the bracket 130 is placed in the channel 114, an inner chamber 122 is formed between the bracket 130 and the speaker 120. The sound generated by the speaker 120 resonates between the bracket 130 and the housing 110 through the inner chamber 122 to the gap D.

Figure 5:
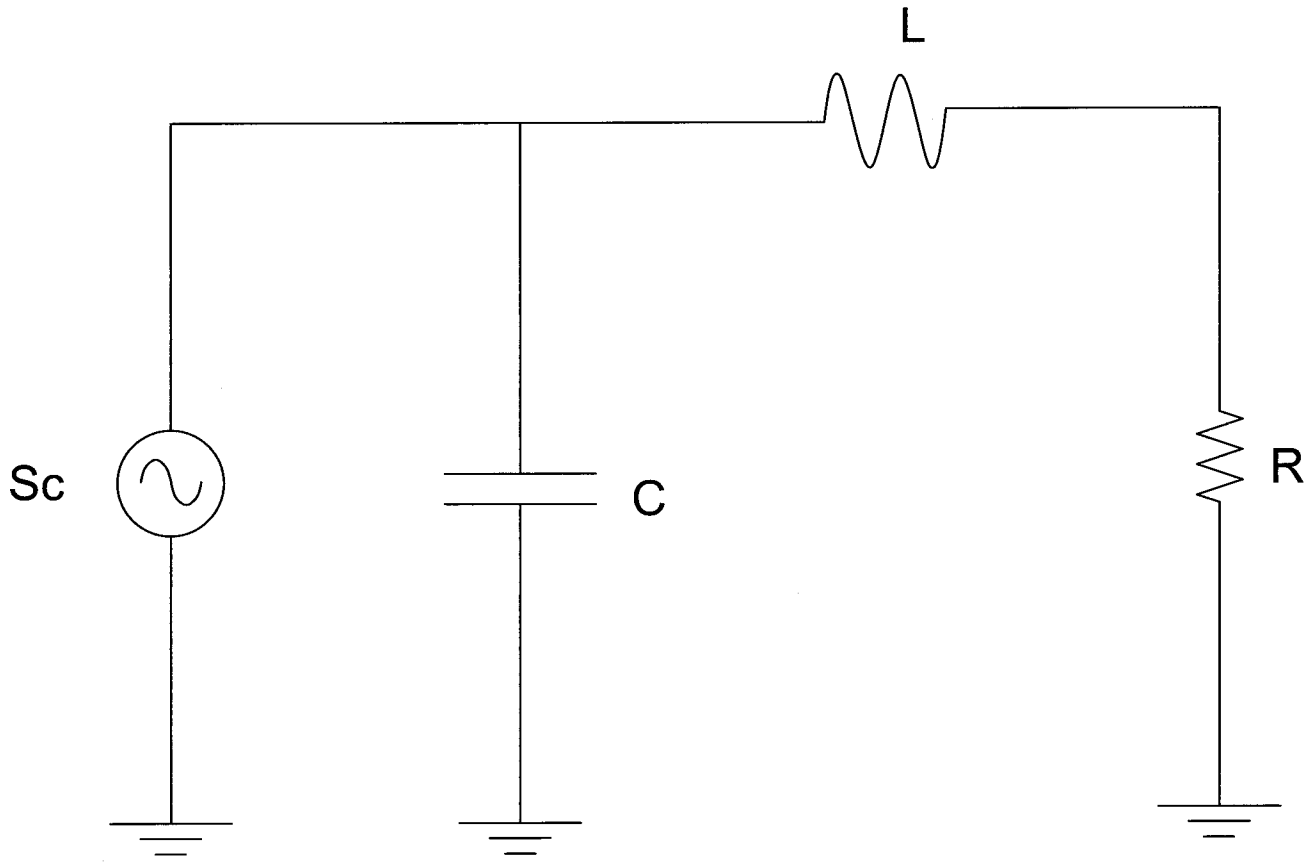
FIG. 5 is an equivalent circuit diagram of the electronic apparatus in FIG. 3.

Please refer to FIG. 5 as an equivalent circuit diagram of an electronic apparatus 100 in FIG. 3, which represents an equivalent circuit of the electronic apparatus 100 when the bracket 130 is closed. A signal source Sc represents an electronic signal received by the speaker 120. C represents an equivalent capacitance value of the inner chamber 122. L represents an equivalent inductance value between the bracket 130 and the housing 110. R represents a resistance value when the sound transmitted to the air. The size of the inner chamber 122 affects the value of the capacitance value C. The size of the gap D affects the value of the inductance value L. The equivalent circuit of the electronic apparatus 100 is a resistor-inductor-capacitor (RLC) oscillator circuit. The resonant frequency of the middle range boost of the electronic apparatus 100 is represented by $f_0$, $f_0$ is equal to $$\frac{1}{2\pi}\sqrt{\frac{1}{LC}}.$$

The middle range is the most significant part of the audible sound spectrum, the region where the most fundamentals emitted by musical instruments and, most importantly, human voice, lie. This region contains most sounds which are the most familiar to the human ear, and where discrepancies from faithful reproduction are most easily observed. It is therefore paramount that a middle range driver of good quality be capable of low-distortion reproduction. Therefore, it is important to achieve a good quality of middle range frequency for reproducing the human voice when user is on the phone. The resonant frequency $f_0$ of the middle range boost of the electronic apparatus 100 depends on the value of the gap D. In an embodiment of the present disclosure, during the design of the electronic apparatus 100, the resonant frequency $f_0$ of the middle range boost of the electronic apparatus 100 is at 6 kHz by setting the size of the gap D, so that the electronic apparatus 100 has a desirable voice and music performance.

In addition, the inductance value L is equal to $$\frac{1.21\times L_K}{W_K\times D},$$

and the unit thereof is the Henry. D is a numerical portion of the volume of the gap D in the unit of cubic meters. The capacitance value C is equal to $$\frac{V}{1.21\times 343},$$

and the unit thereof is Farad. $W_K$ is a numerical portion of the width of the bracket 130 in the unit of meter. $L_K$ is a numerical portion of the length of the bracket 130 in the unit of meter. V is a numerical portion of the volume of the inner chamber 122 in the unit of cubic meters. Therefore, the greater the gap D is, the higher the resonant frequency $f_0$ of the middle range boost of the electronic apparatus 100 is.

Figure 6:
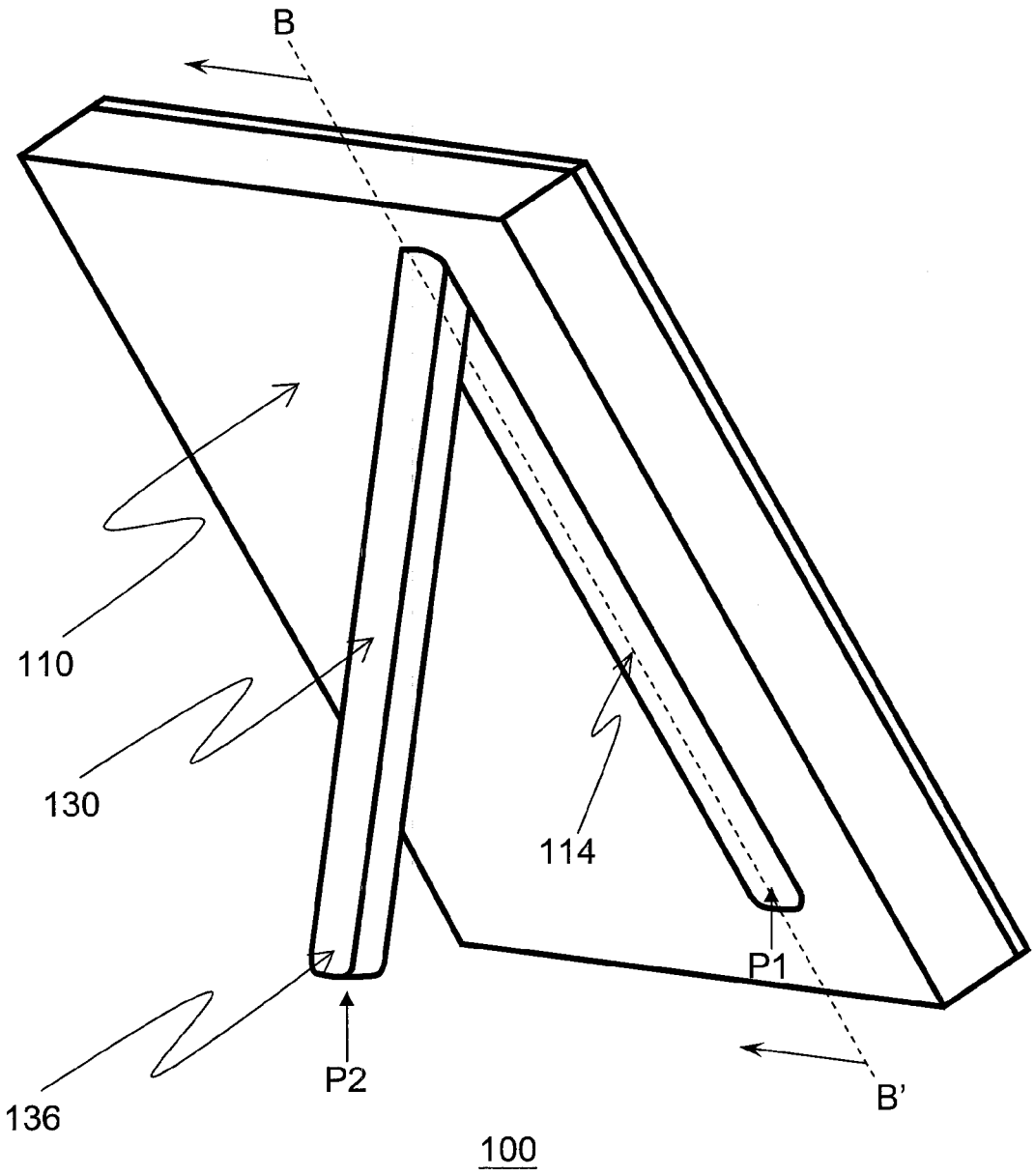
FIG. 6 is a three-dimensional schematic view when the bracket of the electronic apparatus in FIG. 2 is translated or moved to a second position.

Please refer to FIG. 6 and FIG. 2. FIG. 6 is as a three-dimensional schematic view when the bracket 130 of the electronic apparatus 100 is translated or moved to a second position P2. The first end 134 is coupled to the housing 110 and is capable of rotating along an axis 132. The second end 136 is capable of moving from a first position P1 in the channel 114 to the second position P2 away from the channel 114 due to the rotation of the first end 134. When the bracket 130 is opened so that the second end 136 is moved to second position P2 out of the channel 114 due to the rotation of the first end 134, the electronic apparatus 100 is adjusted to a second mode for producing sound. As an angle is formed between the bracket 130 and the housing 110, the electronic apparatus 100 may stand on a surface of an object (e.g. a table). The user usually opens the bracket 130 when playing a multimedia file (e.g. a music file, a video file, etc.), so the second mode may also be referred to as a multimedia mode. The sound quality of the electronic apparatus 100 may be adjusted by changing the placement position of the bracket 130, and the housing 110, the speaker 120 and the bracket 130 may be regarded as a sound system of the electronic apparatus 100.

Figure 7:
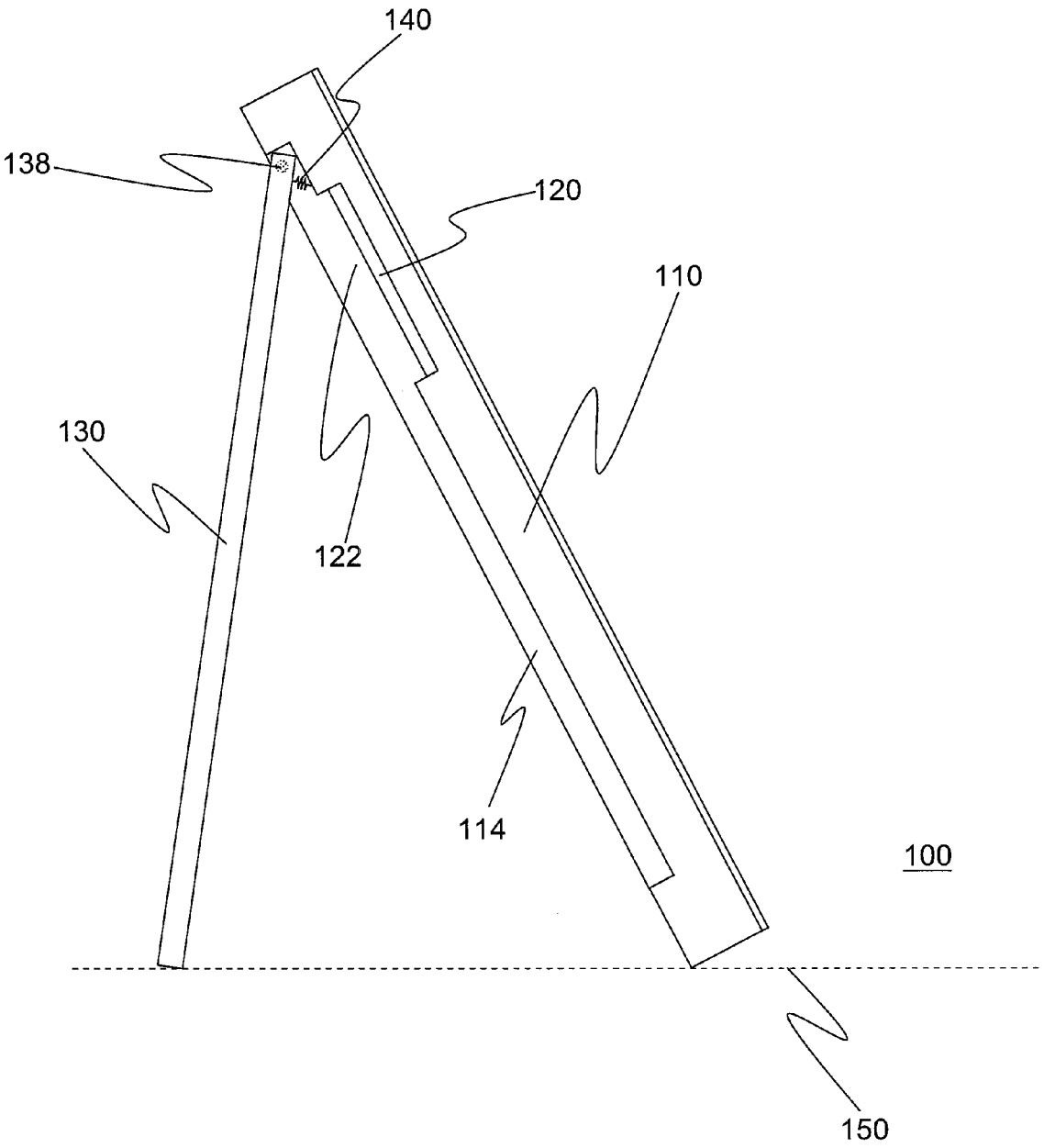
FIG. 7 is a sectional view along a dashed line B-B' of the electronic apparatus in FIG. 6.

Please refer to FIG. 7 as a sectional view along a dashed line B-B' of the electronic apparatus 100 in FIG. 6. When the bracket 130 is opened so that the second end 136 is removed from the channel 114 due to the rotation of the first end 134, as an angle is formed between the bracket 130 and the housing 110, the electronic apparatus 100 may stand on a surface 150 of an object (e.g. a table). The bracket 130 may comprise a bearing or hinge 138 for connecting the first end 134 in a manner that the first end 134 is capable of rotating along the axis 132. A spring 140 may be coupled to the bearing or hinge 138 with the channel 114 so the bracket 130 may be put out of the channel 114 by the spring force when in open position. In addition, the bearing or hinge 138 may be replaced by other connectors. The sound generated by the speaker 120 is transmitted through the inner chamber 122 to the surface 150. As the surface 150 reflects the sound generated by the speaker 120, when the bracket 130 is opened and stands on the surface 150, the user hears the indirect sound reflected by the surface 150. Therefore, the sound pressure level of the acoustic bass sent by the electronic apparatus 100 is increased. Bass is low frequency or range sound. In popular music, the bass part most often provides harmonic and rhythmic support, such that bass is important for playing multimedia sound.

Figure 8:
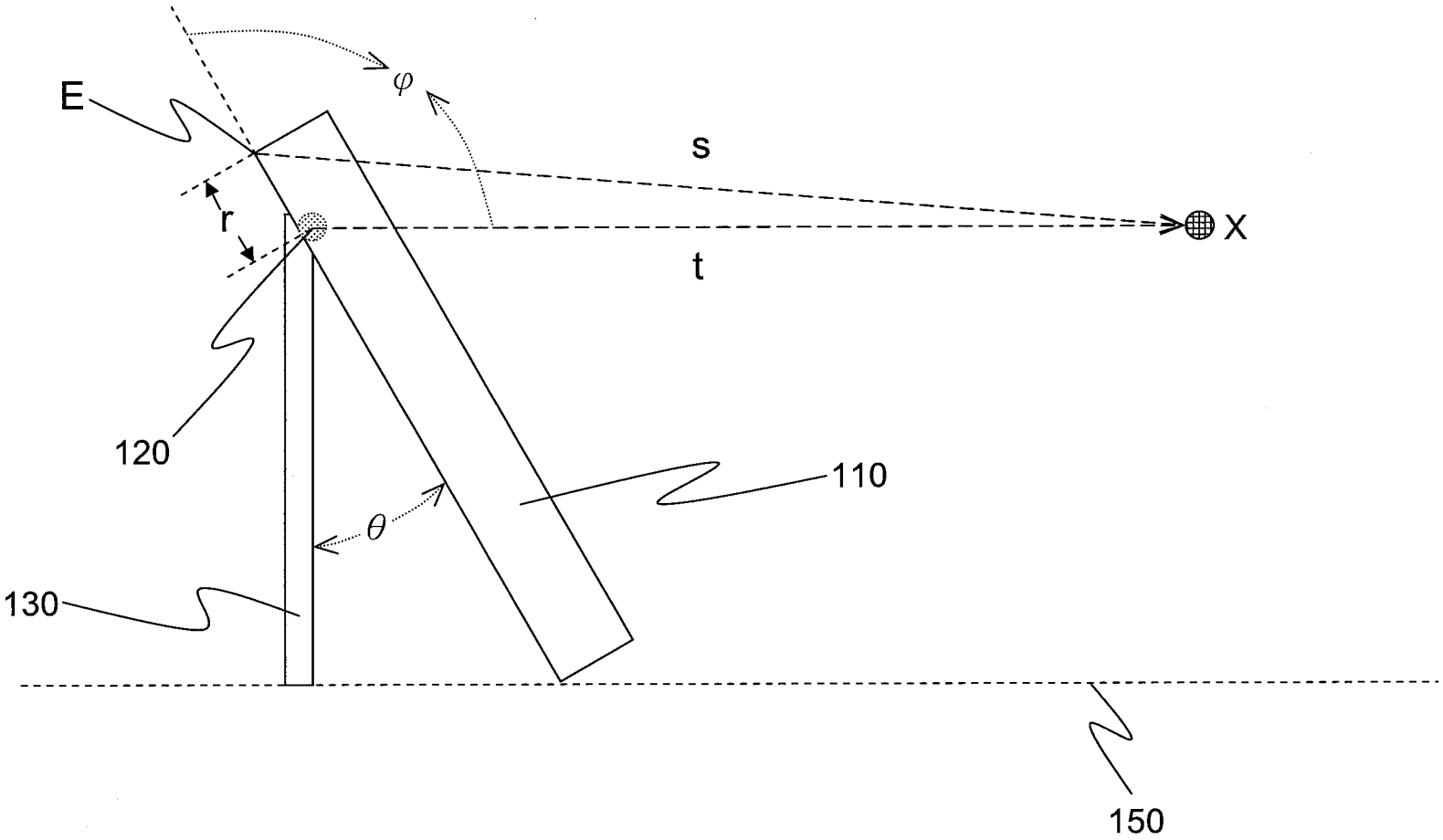
FIG. 8 illustrates a sound diffraction situation of an electronic apparatus according to an embodiment of the present disclosure.

Please refer to FIG. 8 as it illustrates a sound diffraction situation of the electronic apparatus 100. In this embodiment, a sound path from the speaker 120 to the ear X of a user may be simulated as a sound isolation wall. If the sound pressure of the speaker 120 is $P_i$ and the sound pressure at the ear X of the user is $P_o$, the relationship between sound pressures $P_i$ and $P_o$ may be represented by Equation (1) in the following:

$$\left(\frac{P_o}{P_i}\right)_{dB} = -20\times\log_{10}\left(3+40\times\frac{r+s-t}{343.15}\times f\right) \quad (1)$$

The unit of the ratio between the sound pressures $P_i$ and $P_o$ is decibel (dB), f is the frequency of the signal source Sc, r is a distance from the speaker 120 to a top E of the housing 110, s is a distance from the top E to the ear X of the user, and t is a distance from the speaker 120 to the ear X of the user. The unit of the distances r, s and t is meter. According to Equation (1), when the frequency of the signal source Sc increases, the sound pressure $P_o$ decreases, so Equation (1) may be regarded as a bass boost equation. As may be seen, when the bracket 130 is opened, the sound pressure level of the acoustic bass sent by the electronic apparatus 100 may be increased.

In addition, it is assumed that the bracket 130 is perpendicular to the surface 150. An included angle between the bracket 130 and the housing is θ. An included angle between the sound path and the bracket 130 is ϕ. Therefore, the relationships of the distances r, s, t and the included angles θ, ϕ are represented by Equations (2), (3):

$$s^2 = r^2 + t^2 - 2 \times r \times t \times \cos\varphi \quad (2)$$

$$\varphi = \frac{\pi}{2} + \theta \quad (3)$$

Figure 9:
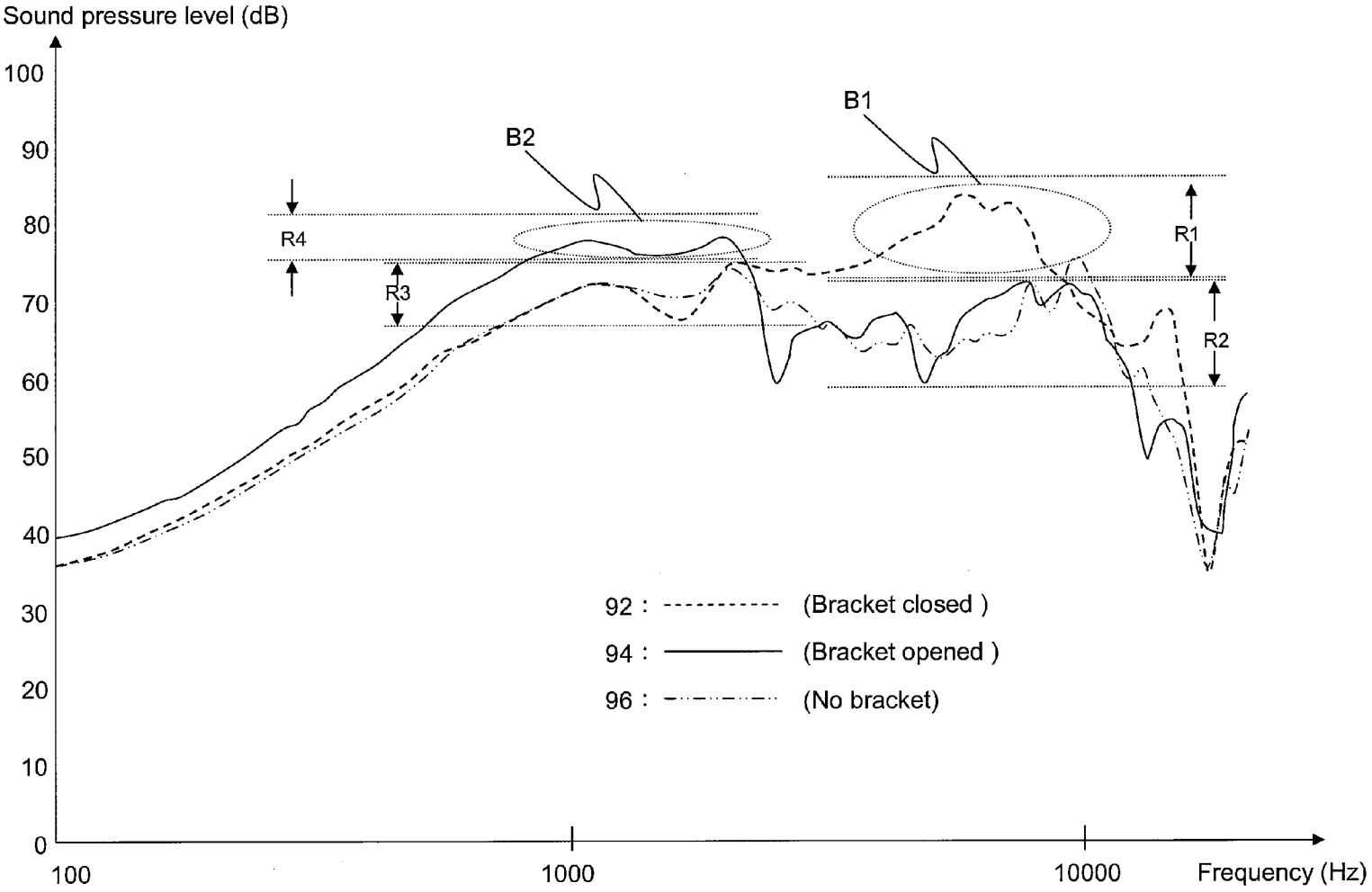
FIG. 9 is a sound frequency response graph of an electronic apparatus in opened position and closed position referred to FIG. 2 and FIG. 6.

Please refer to FIG. 9 as a sound frequency response graph of an electronic apparatus 100 in opened position and closed position referred to FIG. 2 and FIG. 6. The horizontal axis represents a frequency of a sound generated by the electronic apparatus 100. The vertical axis represents a sound pressure level corresponding to each frequency of a sound generated by the electronic apparatus 100 in unit of decibel (dB). A frequency response curve 92 is a sound frequency response curve of the electronic apparatus 100 measured when the bracket 130 is closed as shown in FIG. 2. The frequency response curve 94 is a sound frequency response curve of the electronic apparatus 100 measured when the bracket 130 is opened as shown in FIG. 6. The frequency response curve 96 is a sound frequency response curve of an electronic apparatus without the use of the bracket 130. As shown in FIG. 9, the frequency response curve 92 has a middle range boost B1, which represents that when the bracket 130 is placed in the channel 114, a sound pressure level of the acoustic middle range sound sent by the electronic apparatus 100 is increased. In other words, when the second end 136 of the bracket 130 is placed in the channel 114, the sound pressure level of the acoustic middle range sound sent by the electronic apparatus 100 is falls within a first range R1. When the second end 136 is removed from the channel 114 due to the rotation of the first end 134, the sound pressure level of the acoustic middle range sound sent by the electronic apparatus 100 falls within a second range R2. The first range R1 is higher than the second range R2. In addition, the frequency response curve 94 has a bass boost B2, which represents that when the second end 136 is removed from the channel 114 due to the rotation of the first end 134, a sound pressure level of an acoustic bass sent by the electronic apparatus 100 is increased. In other words, when the second end 136 of the bracket 130 is placed in the channel 114, the sound pressure level of an acoustic bass sent by the electronic apparatus 100 falls within a third range R3. When the second end 136 is removed from the channel 114 due to the rotation of the first end 134, the sound pressure level of the acoustic bass sent by the electronic apparatus 100 falls within a fourth range R4. The third range R3 is lower than the fourth range R4. In such a manner, the sound mode of the electronic apparatus may be switched between two modes, so that the acoustic middle range sound quality and acoustic bass sound quality of the electronic apparatus may be respectively adjusted.

In an embodiment of the present disclosure, the electronic apparatus 100 is a mobile phone or a tablet computer. However, the present disclosure is not limited thereto. In addition, according to an embodiment of the present disclosure, the electronic apparatus 100 may further include a touch screen to be used as an interface for the user to operate the electronic apparatus 100.

The embodiments of the present disclosure, by changing a placement position of a bracket of the electronic apparatus, the acoustic middle range sound quality and acoustic bass sound quality of the electronic apparatus are respectively adjusted.

It will be apparent to those skilled in the art that various modifications and variations may be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A mobile phone, comprising:

a housing, having a space and a channel, wherein the space and the channel are coupled to each other;

a stand, comprising a first end and a second end, wherein the first end is coupled to the channel, and the stand is moved relatively to the housing; and a speaker, disposed in the space, facing toward the stand and configured to generate a sound wave toward the stand, wherein when the second end is disposed inside the channel, an inner chamber is formed between the stand and the speaker to resonate with the sound wave, and when the second end is disposed outside of the channel, the second end of the stand supports the electronic device via the first end, and the sound wave is transmitted out of the electronic mobile phone via the channel, wherein a gap is formed between the stand and the channel when the stand is disposed inside the channel, and a resonant frequency of a middle range boost of the mobile phone depends on a volume of the gap, a width and a length of the stand and a volume of the inner chamber, wherein the volume of the gap determines an equivalent inductance value between the stand and the housing, and the volume of the inner chamber determines an equivalent capacitance value of the inner chamber, wherein the channel and the space are respectively placed at a first region and a second region of a side of the housing which faces to the stand, and when the stand is disposed inside the channel, the gap is formed and placed at the first region, the inner chamber is formed and placed at the second region, wherein the gap has a first distance from the channel to the stand, the inner chamber has a second distance from the speaker to the stand, and the second distance is greater than the first distance.

2. The mobile phone according to claim 1, wherein a sound pressure level of an acoustic middle range sound from the mobile phone with the stand is increased comparing with a sound pressure level of the acoustic middle range sound from a mobile phone without the stand.

3. The mobile phone according to claim 1, wherein a resonant frequency of a middle range boost of the mobile phone is represented by $f_0$, $$f_0 = \frac{1}{2\pi}\sqrt{\frac{1}{LC}},$$

L is an inductance value equal to $$\frac{1.21 \times L_K}{W_K \times D},$$

C is a capacitance value equal to $$\frac{V}{1.21 \times 343},$$

D is a numerical portion of the volume of the gap, $W_K$ is a numerical portion of the width of the stand, $L_K$ is a numerical portion of the length of the stand, V is a numerical portion of the volume of the inner chamber.

4. The mobile phone according to claim 1 further comprising a hinge coupling the stand to the channel.

5. The mobile phone according to claim 1 further comprising a spring coupling the stand to the channel.

6. The mobile phone according to claim 1, wherein the length of the channel is more than twice as much as the length of the space.

7. The mobile phone according to claim 1, wherein the channel is placed along a midline of the housing.

8. The mobile phone according to claim 1, wherein the channel is placed at one end of the housing.

9. The mobile phone according to claim 1, further comprising a touch screen to be used as an interface for operating the mobile phone.

10. The mobile phone according to claim 1, wherein the second end which is moved away from the channel and forming an angle between the stand and housing, the relationship between the angle and distance between a user is represented by $$s^2 = r^2 + t^2 - 2 \times r \times t \times \cos\varphi, \text{ and}$$

$$\varphi = \frac{\pi}{2} + \theta,$$

where r is a distance from the speaker to a top of the housing, s is a distance from the top to the ear of the user, t is a distance from the speaker to the ear of the user, $\phi$ is an included angle between the stand and a sound path from the speaker to the ear of the user, and $\theta$ is an included angle between the stand and the housing.

11. The mobile phone according to claim 1, wherein a sound pressure level of an acoustic bass range sound from the mobile phone with the second end of the stand moved to the second position is increased comparing with a sound pressure level of the acoustic bass range sound from a electronic apparatus mobile phone without the stand.

12. A method for providing a sound system of a mobile phone, comprising:

positioning a speaker of the mobile phone in a space of a housing of the mobile phone;

coupling a first end of a stand to a channel of the housing, wherein the space and the channel are coupled with each other; and moving the stand in the channel, wherein the stand is moved relatively to the housing and comprises the first end and a second, the speaker faces toward the stand and is configured to generate a sound wave toward the stand, when the second end is disposed inside the channel, an inner chamber is formed between the stand and the speaker to resonate with the sound wave, and when the second end is disposed outside of the channel, the second end of the stand supports the electronic device via the first end, and the sound wave is transmitted out of the mobile phone via the channel, wherein a gap is formed between the stand and the channel when the stand is disposed inside the channel, and a resonant frequency of a middle range boost of the mobile phone depends on a volume of the gap, a width and a length of the stand and a volume of the inner chamber, wherein the volume of the gap determines an equivalent inductance value between the stand and the housing, and the volume of the inner chamber determines an equivalent capacitance value of the inner chamber, wherein the channel and the space are respectively placed at a first region and a second region of a side of the housing which faces to the stand, and when the stand is disposed inside the channel, the gap is formed and placed at the first region, the inner chamber is formed and placed at the second region, wherein the gap has a first distance from the channel to the stand, the inner chamber has a second distance from the speaker to the stand, and the second distance is greater than the first distance.

13. The method according to claim 12, further comprising:

positioning the second end of the stand from the first position in the channel to the second position away from the channel.

14. The method according to claim 13, wherein a sound pressure level of an acoustic bass range sound from the mobile phone with the second end of the stand moved to the second position is increased comparing with a sound pressure level of the acoustic bass range sound from an mobile phone without the stand.

15. The method according to claim 12, wherein a sound pressure level of an acoustic middle range sound from the mobile phone with the stand is increased comparing with a sound pressure level of the acoustic middle range sound from an mobile phone without the stand.

16. The method according to claim 12, wherein the length of the channel is more than twice as much as the length of the space.

17. The mobile phone according to claim 1, wherein the channel comprises the stand, and the space comprises the speaker, wherein the volume of the space is greater than the volume of the speaker.

18. The mobile phone according to claim 8, wherein the stand is placed at a back side of the mobile phone.

* * * * *